US005298027A

United States Patent [19]

Kuno et al.

[11] Patent Number: 5,298,027

[45] Date of Patent: Mar. 29, 1994

[54] METHODS OF BLEACHING JEANS

[75] Inventors: Hiroaki Kuno; Kiyotaka Kawanishi, both of Aichi; Hisayuki Komaki, Kanagawa; Yukito Muraguchi, Aichi, all of Japan

[73] Assignee: Inax Corporation, Tokoname, Japan

[21] Appl. No.: 152,122

[22] Filed: Feb. 4, 1988

[30] Foreign Application Priority Data

Mar. 13, 1987 [JP] Japan ..... 62-58056
Mar. 13, 1987 [JP] Japan ..... 62-58057

[51] Int. Cl.[5] ..... D06L 3/06; D06L 3/08

[52] U.S. Cl. ..... 8/108.1; 8/102; 8/111

[58] Field of Search ..... 8/108.1, 137, 111; 427/242, 212, 220; 252/186.2, 186.25, 186.27, 174.13, 91, 95, 187.24, 187.25, 187.26

[56] References Cited

U.S. PATENT DOCUMENTS 4,601,845 7/1986 Namnath ..... 252/99
4,740,213 4/1988 Ricci ..... 8/108.1

FOREIGN PATENT DOCUMENTS 2118463 11/1983 United Kingdom .

*Primary Examiner*—Prince Willis, Jr.
*Attorney, Agent, or Firm*—Kanesaka & Takeuchi

[57] ABSTRACT

Jeans are bleached by rotating glass-expandable ceramics having a bulk specific gravity of 0.7 to 1.2, a 24 hour water absorption of not greater than 5% and the maximum diameter of not greater than 150 mm, water and jeans in a rotary tank. Further jeans are bleached by rotating an air-permeable ceramic porous material having a bulk specific gravity of 0.7 to 1.9, a 24 hour water absorption of 10 to 40% and the maximum diameter of not greater than 150 mm, water and jeans in a rotary tank. In this case, the air-permeable ceramic porous material may also be immersed in a bleaching agent solution.

11 Claims, 1 Drawing Sheet

METHODS OF BLEACHING JEANS

FIELD OF THE INVENTION AND RELATED ART STATEMENT

The present invention relates to methods of bleaching garments of a thick cloth and more particularly, to methods of bleaching jeans which can manufacture jeans having a good texture.

Jeans have spread over wide generations and in recent years, bleached jeans which give a worn-out appearance come into fashion, together with those which are simply dyed and sawed.

Bleached jeans are manufactured by using naturally occurring pumices as media and rotating the pumices together with water and dyed and sawed jeans in a rotary barrel thereby to bleach the jeans so as to have a texture like worn-out jeans. A principal of bleaching according to this method is as follows.

Namely, due to absorption of water into jeans, wrinkles are formed on the surface of the jeans. During operation of the rotary barrel, the convex portions of the wrinkles are progressively abraded with the media to cause bleaching but the concave portions undergo less abrasion, whereby natural bleaching of a delicate texture can be achieved.

For such a reason, in case that heavy, ones such as granite (bulk specific gravity, 2.5–2.8) are used as media, the media strongly strike against the convex and concave portions of the wrinkles upon water absorption so that the convex and concave portions are rendered flat, so natural bleaching involving unevenness cannot be made. To the contrary, media having a bulk specific gravity of 0.9 to 1.8 (1.3 to 1.6 as actually measured data) such as pumice enables to bleach utilizing the wrinkles upon water absorption. Therefore, volcanic pumices having a bulk specific gravity of approximately 1.3 have been used as media for bleaching jeans.

However, when volcanic pumices are used, the following defects encounter.

(1) Pumices are fragile materials and have a low abrasion resistance so that they are abraded during a rotation treatment and large quantities of earth and sand (abraded matters) occur upon disposal of waste water after the treatment and, such makes disposal of waste water difficult. For example, in an ordinary bleaching treatment, about 1 kg of earth and sand occurs per a pair of jeans.

(2) For the same reason, large quantities of earth and sand are adhered to pockets, stitches, etc. of jeans and jeans after bleaching becomes difficult to wash them.

(3) Due to abrasion as stated above, media should be supplemented frequently, which makes a bleaching operation complicated and causes disadvantages from an economical viewpoint.

(4) Pumices are naturally occurring materials so that their hardness, particle size and specific gravity tend to change but control of these factors is not easy and stable bleaching can be made only with difficulty.

(5) Jeans are sometimes contaminated with discolorants derived from naturally occurring matters such as iron.

OBJECTS AND SUMMARY OF THE INVENTION

An object of the present invention is to provide methods of bleaching jeans which has solved the problems described above, minimizes occurrence of earth and sand and makes disposal of waste water easy.

Another object of the present invention is to provide the aforesaid methods of bleaching jeans which makes post treatment of the jeans after bleaching.

A further object of the present invention is to provide the aforesaid methods in which an amount and frequency of replenishing media are reduced.

A still further object of the present invention is to provide methods of bleaching jeans which results in beautiful jeans having a unique texture and free from staining with discolorants such as iron, etc.

These and other objects of the present invention will be apparent from the following description.

In order to solve the problems described above, the present invention provides:

a method of bleaching jeans which comprises rotating glass-expandable ceramics or foamed glass-ceramics having a bulk specific gravity of 0.7 to 1.2, a 24 hour water absorption of not greater than 5% and the maximum diameter of not greater than 150 mm, water and jeans in a rotary tank;

a method of bleaching jeans which comprises rotating an air-permeable ceramic porous material having a bulk specific gravity of 0.7 to 1.9, a 24 hour water absorption of 10 to 40% and the maximum diameter of not greater than 150 mm, water and jeans in a rotary tank; and, a method of bleaching jeans which comprises immersing an air-permeable ceramic porous material having a bulk specific gravity of 0.7 to 1.9, a 24 hour water absorption of 10 to 40% and the maximum diameter of not greater than 150 mm in a bleaching agent solution and rotating said decolorant-immersed air-permeable ceramic porous material, water and jeans in a rotary tank.

DETAILED DESCRIPTION OF THE PREFERRED EMBODIMENTS

Figure 1:
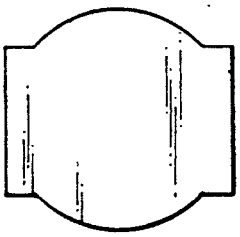
FIG. 1 is a side view of an air-permeable ceramic porous matter used in the examples.

The glass-expandable ceramics or formed glass-ceramics used in the present invention have a bulk specific gravity of 0.7 to 1.2, 24 hour water absorption of not greater than 5% and the maximum diameter of not greater than 150 mm.

The bulk specific gravity of the glass-expandable ceramics is a factor which affects the bleaching degree of jeans. When the bulk specific gravity is less than 0.7, a sufficient bleaching efficiency cannot be obtained. Conversely when the bulk specific gravity exceeds 1.2, a degree of collision with wrinkles of jeans upon water absorption is too much so that jeans having a good texture cannot be obtained by bleaching utilizing the wrinkles. It is particularly preferred that the bulk specific gravity be about 1.

A composition of this glass is not particularly limited but may be insoluble in water. Silicate type glass such as sodium silicate glass, sodium boric silicate glass, aluminosilicate glass, etc. can generally be advantageously obtained.

In the case of sodium silicate glass, one having a true specific gravity of 2.3 has a porosity of about 53% when a bulk specific gravity is.1.0, a porosity of about 48% when the bulk specific gravity is 1.2 and a porosity of about 65% when the bulk specific gravity is 0.8. The glass-expandable ceramics have closed pores. It is preferred that the pore diameter be less than 3 mm, in particular, less than 2 mm and a mean diameter be in a range of approximately 0.3 to 1.5 mm. When the water absorption of glass-expandable ceramics is too large, the specific gravity increases because of water absorption so that failure to bleach jeans occurs in some occasion. For this reason, in the present invention, the 24 hour water absorption is set to be 5% or less, preferably 1% or less. The water absorption may be 0%.

In the specification, the 24 hour water absorption is expressed, when an amount of water to be absorbed 24 hours after is a part by weight upon immersion of 100 parts by weight of dry ceramics in water, by a% in the 24 hour water absorption.

In the present invention, the maximum diameter of the glass-expandable ceramics is 150 mm or less. When the diameter of the glass-expandable ceramics is excessively large, operability becomes poor. It is preferred that the maximum diameter of the glass-expandable ceramics be 100 mm or less.

When the glass-expandable ceramics are supplied in a rotary barrel for the first time together with jeans and water, it is preferred that the minimum diameter be 5 mm or more. However, this is not essential because the ceramics which rotate with jeans are gradually abraded to reduce the diameter to less than 5 mm in some occasion and even these small ceramics can contribute to bleaching. However, ceramics having a diameter of less than 1 mm would not play a great role in bleaching.

In the present invention, a shape of the glass-expandable ceramics is not particularly limited but they may be in various shapes such as a sphere, an ellipse, a polyhedron, etc. Further ceramics of a cylindrical or almost cylindrical shape having a diameter of approximately 10 to 80 mm and a length of approximately 10 to 150 mm may also be used.

The glass-expandable ceramics used in the present invention can be prepared, for example, by mixing a foaming agent and a suitable foaming aid such as calcium carbonate or carbon in finely divided glass powders in a given formulation, charging the mixture in a mold, foaming with heating and then gradually annealing.

The glass-expandable ceramics having a rough surface provide a bleaching effect better than those having a smooth surface. Of course, even the glass-expandable ceramics having a smooth surface are gradually abraded when rotating together with jeans, whereby the surface layer is scraped off to expose internal pores onto the surface. That is, the surface becomes rough. Accordingly, the roughness on the surface of the glass-expandable ceramics is not necessarily required. In the case of using the ceramics having a smooth surface, a time period for subjecting jeans to a rotation treatment may be prolonged to some extent, as compared to the case in which the ceramics having a rough surface are used.

The glass-expandable ceramics having a smooth surface may be used for the bleaching treatment after they are previously subjected to a surface roughening treatment. For roughening, large quantities of ceramics having a smooth surface are charged in a rotary mill and the mill is rotated so as to abrade the surface of the powders with each other.

Figure 3:
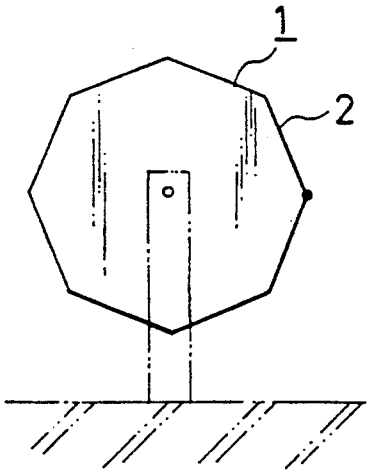
FIG. 3 shows an outlined side view of a rotary barrel.
Figure 4:
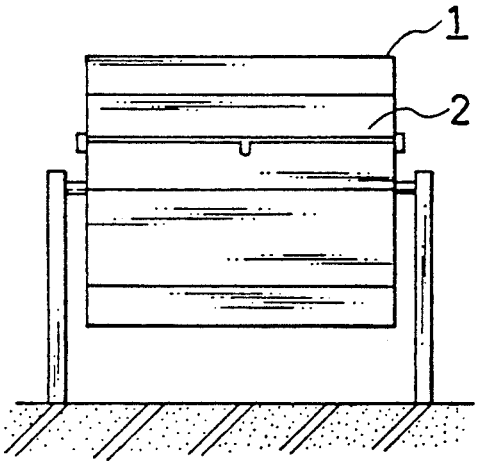
FIG. 4 shows a front view of the same rotary barrel.

To practice the methods of the present invention, a ball mill-like barrel 1 as shown in FIG. 3 and FIG. 4 is used and the glass-expandable ceramics, water and jeans are charged in the barrel 1 through a charging opening of switchgear system and are rotated. It is preferred that a diameter of the barrel be approximately 50 cm to 3 m. It is also preferred that the barrel be rotated at 10 to 150 rpm. It is preferred that a rotating time be approximately 10 minutes to an hour.

In this case, a proportion of the glass-expandable ceramics, water and jeans charged varies depending upon physical properties of the glass-expandable ceramics and a bleaching degree of jeans but it is generally preferred that 1 to 20 kg of the glass-expandable ceramics and 1 to 10 liters of water be charged per a pair of jeans. A rotating time and rotation number of the barrel are appropriately determined depending upon physical properties of the glass-expandable ceramics used, proportion charged, a bleaching degree, etc.

The thus bleached jeans are subjected to post treatments such as rinsing, etc. and then provided as commercial goods.

The glass-expandable ceramics have a hardness higher than pumices, etc. but are not fragile so that they are hardly abraded.

Therefore, occurrence of earth and sand due to abrasion is reduced and, disposal of waste water and a finishing treatment of jeans become easy. In addition, an amount to be replenished which corresponds to the amount abraded is also reduced so that operations for replenishing, etc. are reduced and efficiency is improved.

Further, the glass-expandable ceramics used in the present invention are as light as having a bulk specific gravity of 0.7 to 1.2 and have small water absorption. Therefore, mild bleaching can be made, making the best use of wrinkles of jeans upon water absorption and jeans having a good texture can be obtained.

Furthermore, there is no chance that decolorants such as iron, etc. derived from naturally occurring matters are intermingled and therefore, contamination of jeans can be prevented.

In another embodiment of the present invention, jeans are bleached by rotating them together with the air-permeable ceramic porous material and water in a rotary tank. In this case, the air-permeable ceramic porous material may be immersed in a bleaching agent solution.

The air-permeable ceramic porous material, i.e., having continuous pores as used herein has a bulk specific gravity of 0.7 to 1.9, a 24 hour water absorption of 10 to 40% and the maximum diameter of not greater than 150 mm.

The bulk specific gravity of the air-permeable ceramic material is a factor which affects the bleaching degree of jeans. When the bulk specific gravity is less than 0.7, a sufficient bleaching efficiency cannot be obtained. Conversely when the bulk specific gravity exceeds 1.9, a degree of collision with wrinkles of jeans upon water absorption is too much so that jeans having a good texture cannot be obtained by bleaching utilizing the wrinkles. It is particularly preferred that the bulk specific gravity be approximately 0.8 to 1.6.

When the water absorption of the air-permeable ceramic material is too large, the porous material has a poor strength and therefore, there is a possibility that abrasion resistance might be insufficient. Further the specific gravity increases because of water absorption so that failure to bleach jeans occurs in some occasion. Conversely, when the water absorption is too small, an immersion efficiency becomes poor upon immersion of a bleaching agent and a bleaching efficiency also tends to decrease. For these reasons, in the present invention, the 24 hour water absorption is set to be 10 to 40%, preferably 20 to 30%.

In the specification, the 24 hour water absorption is expressed, when an amount of water to be absorbed 24 hours after is a part by weight upon immersion of 100 parts by weight of dry ceramics in water, by a% in the 24 hour water absorption.

In the present invention, the maximum diameter of the air-permeable ceramic material is 150 mm or less. When the diameter of the air-permeable ceramic material is excessively large, operability becomes poor. It is preferred that the maximum diameter of the air-permeable ceramic material be 100 mm or less. It is preferred that the minimum diameter of the porous material be 5 mm or more but this is not essential.

Figure 2:
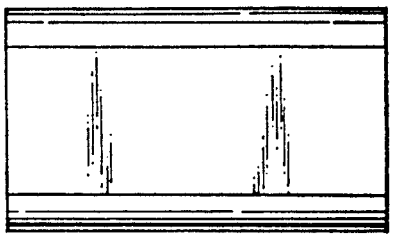
FIG. 2 shows a front view of the same porous matter.

In the present invention, a shape of the air-permeable ceramic material is not particularly limited but they may be in various shapes such as a sphere, a cylinder, a square pillar, a rectangular parallelepiped, a cube. In addition, a substantially cylindrical shape as shown in FIG. 1 and FIG. 2 may also be used.

Further, a ceramic composition of the air-permeable ceramic porous material preferably contains 70 to 88 wt % of $SiO_2$, 5 to 23 wt % of CaO and 5 to 15 wt % of $Al_2O_3$. Namely, the ceramics having such a composition can provide a porous material having uniform porosity, uniform pore radius and high hardness. Particularly in view of uniformity in porosity and pore and fragility, the most preferred ranges are 70 to 80 wt % of $SiO_2$, 10 to 23 wt % of CaO and 5 to 15 wt % of $Al_2O_3$. The porous material having such a composition has a pore radius of 0.3 to 50 μm and is extremely uniform.

Such an air-permeable ceramic porous material can easily be prepared as being a uniform air-permeable porous material having a uniform pore diameter, using as starting raw materials siliceous agalmatolite, preferably pyrophyllite and/or kaolin provided from natural raw materials at low costs having about 13 wt % or less of $Al_2O_3$, lime stone and clay to make a composition of 70 to 88 wt % of $SiO_2$, 5 to 23 wt % of CaO and 5 to 15 wt % of $Al_2O_3$ and, if necessary, incorporating a molding aid such as an organic binder, etc., molding in a conventional manner and sintering the molded article at 1000° to 1350° C. thereby to cause the reaction between the liquid phase and the solid phase during sintering. When the molded article is sintered at 1000° to 1350° C., especially at 1120° to 1280° C., the sintered material having continuous pores can be obtained. The sintered material is a porous material having continuous pores while the matrix per se is dense.

In the method of the present invention, such an air-permeable ceramic porous material can also be used by immersing the porous material in a bleaching agent.

In the case of immersing in the bleaching agent, it is preferred that the air-permeable ceramic porous material be one having a porosity of approximately 30 to 70% and continuous pores of approximately 0.3 to 50 μm.

As the bleaching agent used in this case, mention may be made of bleaching agents of chlorine compound type such as sodium hypochlorite, sodium chlorite, bleaching powders, etc., oxidation bleaching agents or reduction bleaching agents such as bleaching agents of peroxide type, etc.

An amount of the bleaching agent in which the air-permeable ceramic porous material is to be immersed can be appropriately determined depending upon physical properties of the air-permeable ceramic porous material, a bleaching degree of jeans, bleaching efficiency of the bleaching agent used, etc.

In the case of using the bleaching agent, natural bleaching unevenness results in due to a more vigorous bleaching action, whereby jeans having a unique texture can be obtained.

In an ordinary case, the bleaching agent is used in an aqueous solution. For example, the bleaching agent described above is dissolved in water in a concentration of approximately 3 to 30 wt % and the air-permeable ceramic porous material is immersed in the aqueous solution for 1 to 10 minutes or longer, whereby the solution permeates into cavities of the porous material in more than 70 to 80%. The porous material in which the solution is absorbed is picked up from the solution and allowed to stand for approximately 20 minutes to 3 hours to effect straining so as to make the surface semi-dry. This porous material is charged in a rotary tank together with jeans and water and the rotary tank is rotated. By the rotation, the porous materials in which the bleaching agent is absorbed strike against jeans and the bleaching agent adheres to portions against which the porous materials strike and bleaching occurs at the portions. That is, the jeans are not bleached uniformly as a whole but uneven bleaching occurs in such a manner that spots are formed. This is extremely different from the case in which a bleaching agent aqueous solution and jeans are simply charged in a rotary tank and the tank is rotated.

To practice the methods of the present invention, a ball mill-like barrel 1 as shown in FIG. 3 and FIG. 4 is used and the air-permeable ceramic materials in which the bleaching agent is incorporated or no bleaching agent is incorporated, water and jeans are charged in the barrel 1 through a charging opening of a switchgear system and are rotated. A diameter and rotation time of the barrel may be similar to those as described above.

In this case, a proportion of the air-permeable ceramic material, water and jeans charged varies depending upon physical properties of the air-permeable ceramic material, presence or absence of the bleaching agent and a bleaching degree of jeans but it is generally preferred that 1 to 20 kg of the air-permeable ceramic material and 1 to 10 liters of water be charged per a pair of jeans. A rotating time and rotation number of the barrel are appropriately determined depending upon physical properties of the air-permeable ceramic material used, proportion charged, a bleaching degree, etc.

The thus bleached jeans are subjected to post treatments such as rinsing, etc. and then provided as commercial goods.

The air-permeable ceramic material has a hardness higher than pumices, etc. and is not fragile so that the material is hardly abraded.

Therefore, occurrence of earth and sand due to abrasion is reduced and, disposal of waste water and a finishing treatment of jeans become easy. In addition, an amount to be replenished which corresponds to the amount abraded is also reduced so that operations for replenishing, etc. are reduced and efficiency is improved.

Further, the air-permeable ceramic material used in the present invention is as light as having a bulk specific gravity of 0.7 to 1.9 and has small water absorption.

Therefore, mild bleaching can be performed, making the best use of wrinkles of jeans upon water absorption and jeans having a good texture can be obtained.

Furthermore, there is no chance that discolorants such as iron, etc. derived from naturally occurring matters are intermingled and therefore, contamination of jeans can be prevented.

The air-permeable ceramic porous material has a water absorption property to a suitable degree so that the bleaching agent can be impregnated therewith and also in this case, abrasion is prevented and operations can be performed over a long period of time.

As explained above, occurrence of earth and sand is reduced and disposal of waste water becomes easy and at the same time, a post treatment of the bleached jeans becomes easy in accordance with the present invention, as compared to the conventional method using naturally occurring pumice.

According to the present invention, the ceramics that are used for a bleaching treatment of jeans in one batch can be used for a treatment in another batch. The ceramics have a better abrasion resistance than that of natural pumice so that they can be used in a plurality of batches repeatedly. When the ceramics are abraded and reduced in some batch, a desired amount of ceramics can be replenished. As described above, however, an amount lost due to abrasion is minimized so that amounts of the glass-expandable ceramics and air-permeable ceramic porous material to be replenished and replenishing frequency can be reduced.

Furthermore, the air-permeable ceramic porous material used in the present invention is relatively light-weighted so that mild bleaching can be achieved, making the best use of wrinkles of jeans when water is absorbed therein.

In addition, no contamination occurs with discolorants such as iron, etc.

Further by using the bleaching agent which is impregnated with the ceramics, efficient bleaching can be conducted. In addition, abrasion of the air-permeable ceramic porous material is smaller than volcanic pumice also in this case.

Therefore, according to the methods of the present invention, jeans can be bleached at low costs in high efficiency and, by bleaching, jeans having a good texture and a high commercial value can be obtained.

EXAMPLE 1

In a rotary barrel (volume of 160 liters) shown in FIG. 3 and FIG. 4 were charged 15 kg of glass-expandable ceramics, 20 liters of water and 4 pairs of jeans prepared by sewing a cloth dyed to a deep blue color. The barrel was rotated at 50 rpm for 17 minutes to bleach the jeans.

As a result, the jeans having a good texture which was bleached to an appropriate degree as in a conventional manner (Comparative Example 1 later described) using natural pumice were obtained. Earth and sand occurred by abrasion of the ceramics was 400 g. Operation for disposal of waste water and operation for rinsing the jeans were easy to make.

Properties of the glass-expandable ceramics used herein and a method for production thereof are as follows.

Properties bulk specific gravity: 0.8–1.2
water absorption: 0.2% or less
shape: cylinder having a diameter of about 30 mm and a length of about 20 mm
weight: 11 to 17 g per one ceramic

Method for production

Firstly, 60 wt % of volcanic ash, 20 wt % of silica, wt % of Kibushi clay and 0.15 wt % of silicon carbide were grained and kneaded in a trommel mill to prepare raw powders having a mean grain diameter of about 10 μm. A composition of the raw powders is as follows.

$SiO_2$: 77 wt %
$Al_2O_3$: 12 wt %
$K_2O$: 4 wt %
$Na_2O$: 4 wt %
Ig. loss: 3 wt %

The raw powders were granulated by a spray drier device to make a granulate raw material having a moisture content of about 4 wt % and a mean grain diameter of 200 μm.

Next, the granulate raw material was press molded in a mold followed by sintering at 1280° C. for 4 hours to prepare the glass-expandable ceramics described above. A pressure upon the press molding was 200 kg/cm$^2$ (1960 N/cm$^2$). Further the sintering was carried out in a tunnel furnace using a light oil as a fuel.

EXAMPLE 2

The glass-expandable ceramics having the same size and material were prepared in a manner similar to Example 1. In a trommel mill having a volume of 100 liters were charged 50 kg of the ceramics together with 10 liters of water followed by rotating at 50 rpm for 20 minutes. By doing so, the ceramic surface became such a state that the skin was thinly scraped off and the ceramics became rough surface. Properties of the ceramics are as follows:

bulk specific gravity: 0.8–1.2
water absorption: 0.2% or less
shape: a diameter of about 30 mm and a length of about 20 mm
weight: 15 to 16 g per one ceramic About 100 kg of the ceramics were charged in an octahedral barrel having a length of 2 m and the maximum diameter of 2 m, together with 30 pairs of jeans and 140 liters of water followed by rotating at 50 rpm for 18 minutes. The rotating direction was reversed every 8 rotations.

Also by this treatment, the bleached jeans having a good texture were obtained. Earth and sand occurred by abrasion of the ceramics were 5 kg. Operation for disposal of waste water and operation for rinsing the jeans were easy to make.

EXAMPLE 3

Bleaching of jeans were performed in a manner similar to Example 1 except for using 20 kg of the air-permeable ceramic porous material as described below:

Air-permeable ceramic porous material bulk specific gravity: 1.6
water absorption: 15% (porosity, 40%)
shape: cylinder having a diameter of about 30 mm and a length of about 18 mm
weight: 20 g per one ceramic As a result, the finishing of the jeans as extremely good in texture, while the finishing was somewhat flat as that in Comparative Example 1 using natural pumice.

On the other hand, earth and sand occurred by abrasion of the air-permeable ceramic porous material was about 500 g which was ⅓ that of the pumice in Comparative Example 1. Operations for disposal of waste water and rinsing of the jeans were greatly reduced.

A method of preparing the air-permeable ceramic porous material is as follows.

Firstly, 2100 kg of agalmatolite, 660 kg of lime stone and 240 kg of Gairome-clay were grained and kneaded in a trommel mill to prepare a raw slurry. A mean grain diameter contained in the slurry was about 10 μm.

The raw slurry was granulated by a spray drier device to make a granulate raw material. A mean grain diameter was 200 μm and a moisture content was about 4 wt %.

The grains were molded and sintered in a manner similar to Example 1 to prepare the air-permeable ceramic porous material described above.

EXAMPLE 4

Procedures were conducted in a manner similar to Example 3 except that the air-permeable ceramic porous material used in Example 3 with which about 10 g/grain of a sodium hypochlorite aqueous solution having a concentration of 20 wt % was impregnated was used and the rotation time was made 17 minutes.

As the result, jeans having a texture similar to the jeans obtained in Example 3 were obtained by the treatment in a short period of time.

Further earth and sand occurred by abrasion was 500 g. Disposal of waste water and rinsing treatment of the jeans were easy.

EXAMPLE 5

An air-permeable ceramic porous material of a cylindrical shape having a diameter of 30 mm and a length of 18 mm and having a weight of 20 g per one ceramic and a porosity of 15% was prepared in a manner similar to Example 3.

The ceramics were immersed in a sodium hypochlorite aqueous solution having a concentration of 20 wt % to absorb 4 g/one of water therein. And 100 kg of the ceramics were charged in the barrel as used in Example 2, together with 30 pairs of jeans and 20 liters of water followed by rotating 50 rpm for 20 minutes.

As the result, the jeans having a good texture were obtained. Earth and sand occurred by abrasion was 8 kg. Disposal of waste water and rinsing treatment of the jeans were easy.

COMPARATIVE EXAMPLE 1

In a rotary barrel (volume of 160 liters) shown in FIG. 2 (a) and (b) were charged 15 kg of naturally occurring pumice (bulk specific gravity of 1.3; 30 mm (diameter)×50 mm (length); about 45 g/one), 20 liters of water and 4 pairs of jeans. The barrel was rotated at 50 rpm for 17 minutes to bleach the jeans.

As the result, mild bleaching of the jeans could be performed, making the best use of wrinkles and the finishing was made to have a good texture. However, due to abrasion of the pumice, about 4 kg of earth and sand occurred. Operation for disposal of waste water and operation for rinsing the jeans were extremely difficult to make.

What is claimed is:

1. A method of bleaching jeans, comprising rotating foamed glass-ceramics, water and jeans in a rotary tank, each ceramic having a silicate glass type composition with closed pores, bulk specific gravity of 0.7 to 1.2, 24 hour water absorption of not greater than 5% and the maximum diameter of not greater than 150 mm, the most of the ceramics having the diameter more than 5 mm.

2. A method according to claim 1 wherein a diameter of said rotary tank is 50 cm to 3 m and said rotation is performed in said rotary tank in proportions of 1 to 20 kg of said ceramics and 1 to 10 liters of water based on a pair of jeans.

3. A method according to claim 1 wherein a time period for the rotation is 10 minutes to an hours and a rotation number is 10 to 150 rpm.

4. A method according to claim 1 wherein said foamed glass-ceramic are surface roughened.

5. A method of bleaching jeans comprising immersing air-permeable ceramic porous materials in a bleaching agent solution, each ceramic material having bulk specific gravity of 0.7 to 1.9, 24 hour water absorption of 10 to 40%, the maximum diameter of not greater than 150 mm and pores with the radius of 0.3 to 50 micron, the minimum diameter of the ceramic porous materials being 5 mm or more, rotating said immersed air-permeable ceramic porous materials, water and jeans in a rotary tank, removing the jeans from the rotary tank after bleaching, and rinsing the jeans with water.

6. A method according to claim 5 wherein a diameter of said rotary tank is 50 cm to 3 m and said rotation is performed in said rotary tank in proportions of 1 to 20 kg of said ceramic porous material and 1 to 10 liters of water based on a pair of jeans.

7. A method according to claim 5 wherein a time period for the rotation is 10 minutes to an hour and a rotation number is 10 to 150 rpm.

8. A method according to claim 5 wherein said bleaching agent is selected from a chlorine bleaching agent, an oxidative bleaching agent or reductive bleaching agent.

9. A method according to claim 5 wherein said bleaching agent is formed in an aqueous solution thereof, said ceramic porous material is immersed in said solution, then pulled up and drained so as to have a semi-dried surface and then used for said bleaching of jeans.

10. A method of bleaching jeans, comprising:

preparing air-permeable ceramic porous materials, each having bulk specific gravity of 0.7 to 1.9, 24 hour water absorption of 10 to 40%, the maximum diameter not greater than 150 mm, and continuous pores with the radius of 0.3 to 50 microns, the minimum diameter of the ceramic porous materials being 5 mm or more, immersing the ceramic porous materials in a bleaching agent solution to allow the bleaching agent to permeate into the pores of the ceramic porous materials, removing the ceramic porous materials from the bleaching agent solution, and at least partially drying the immersed ceramic porous material, charging unbleached jeans, water and the ceramic porous materials with the bleaching agent in a rotary tank, and rotating the rotary tank so that the ceramic porous materials with the bleaching agent irregularly contacts the jeans to thereby provide uneven bleaching of the jeans.

11. A method of bleaching jeans according to claim 10, further comprising after partially bleaching the jeans, removing the jeans from the rotary tank, and rinsing jeans with water.

* * * * *